US005377700A

United States Patent [19]

Harris

[11] Patent Number: 5,377,700

[45] Date of Patent: Jan. 3, 1995

[54] EYELASH CURLER

[76] Inventor: Ilise H. Harris, 529 W. 42nd St., No. 4V, New York, N.Y. 10036

[21] Appl. No.: 100,544

[22] Filed: Jul. 30, 1993

[51] Int. Cl.[6] ..... A45D 2/48

[52] U.S. Cl. ..... 132/217; 132/216

[58] Field of Search ..... 132/216, 217

[56] References Cited

U.S. PATENT DOCUMENTS

| | | | |
|---|---|---|---|
| 210,180 | 2/1968 | Solomon . | |
| 1,527,964 | 2/1925 | Patino . | |
| 1,665,327 | 4/1928 | Rissinger | 132/217 |
| 1,920,401 | 8/1933 | Kahn . | |
| 2,133,042 | 10/1938 | Risberg | 132/217 |
| 2,168,370 | 8/1939 | Solomon . | |
| 2,214,318 | 9/1940 | Bernstein | 132/217 |
| 2,323,595 | 7/1943 | Hanisch . | |
| 2,392,694 | 1/1946 | Rector . | |
| 3,547,135 | 12/1970 | Roos . | |
| 3,625,229 | 12/1971 | Silson | 132/216 |
| 3,640,290 | 2/1972 | Theis . | |
| 3,670,742 | 6/1972 | Weaner | 132/216 |
| 3,722,519 | 3/1973 | Epstein . | |
| 3,828,803 | 8/1974 | Windsor | 132/216 |
| 4,305,412 | 12/1981 | Nist . | |
| 4,993,439 | 2/1991 | Davies | 132/217 |

FOREIGN PATENT DOCUMENTS

| | | | |
|---|---|---|---|
| 1021063 | 2/1966 | United Kingdom | 132/216 |

*Primary Examiner*—Gene Mancene
*Assistant Examiner*—Frank A. LaViola
*Attorney, Agent, or Firm*—Michael N. Meller

[57] ABSTRACT

An improved eyelash curler comprises upper and lower concave jaws, the sides of each jaw forming an aperture through which the person curling can, by a mirror, observe and accurately apply the device. The jaws are normally kept open by a spring. Two finger tabs on each jaw, located near the concave jaws, allow for two handed operation.

8 Claims, 1 Drawing Sheet

EYELASH CURLER

FIELD OF INVENTION

This invention relates to a device for curling an eye lash.

BACKGROUND

Eyelash curlers appearing in the prior art are a scissors like instrument, using indirect force, or a squeeze jaws type that uses direct force. Both types of curlers use only one hand to apply pressure to the eyelash. The fingers that apply pressure and guide these devices are located a considerable distance from the eyelash to be curled.

Current direct force eyelash curlers obscure the vision of the eye that lashes are to be curled. This reduces the accuracy of the application of the device. Also, placing a device so close to the eye with poor visibility is intimidating to the user.

Current indirect force eyelash curlers are very awkward to use. The hand guiding the device can be in a wide range of angles, confusing the user as to what angle the device should be used The use of only one hand to produce curling force produces several undersirable results. The pressure available from only one hand limits the pressure available to produce the curl, a single hand operation is unsteady and the act of squeezing to apply the pressure can introduce an unwanted shift in position of the device being used. One unwanted effect of eyelash curlers of the prior art is that user may accidentally pull out eyelashes.

With both types of devices, the greater the distance between the guiding fingers and the eyelash, the greater the effect of any unwanted finger motion, resulting in a less accurate placement of the device and a poorer curl.

SUMMARY

The improved eyelash curler of the present invention gives a better curl than previous devices because of the viewing aperture created by the jaws, the two-handed operation, and the location of the finger tabs close to the eyelash to be curled.

The viewing aperture enables the user to more accurately place, with regard to other direct force appliances, the device on the eyelashes because it provides a direct view of the operation.

Two-handed operation produces several favorable results. It enables the user to apply more pressure to the lash, delivering a better curl. It also produces more control and thus, is less intimidating to the user, e.g. a steadier application of pressure as unwanted side-to-side moves during curling are nearly cancelled by the opposing hand. A steadier application results in reduced eyelash loss.

The placement of the finger tabs near the lash to be curled also produces several favorable results. It enables the pressure to be applied to the lash more accurately than in previous devices because the pressure is direct rather than indirect. This placement also eliminates confusion on the part of the user of conventional indirect force appliances as to what angle to place the device in reference to the face. The user is less intimidated by having the controlling fingers closer to the eye and the grip is less awkward. The finger tabs are what allow for a two-handed application.

DESCRIPTION

Figure 1:
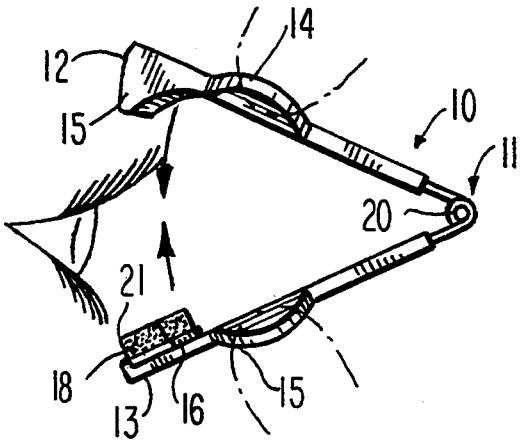
FIG. 1 is a side view of the eyelash curler.

The eyelash curler (10) is a set of hollowed jaws, an upper jaw (12) and a lower jaw (13), made of metal or plastic, connected by a spring (11) and normally open to an angle of approximately 30°. Two finger tabs (14) and (15) are mounted on the exterior of each jaw back far enough from the open end of the jaws to remain outside the eye socket during curling when the device is closed. The jaws are hollowed sufficiently to allow viewing through them and have a concave face, the curve of which approximates the curvature of the eye. The concave face of the upper jaw has a metal blade (17) approximately 1-¼ inches long, approximately ¼ inch high and approximately 1 millimeter thick, the bottom edge of which is rounded. The concave face of the lower jaw has a metal blade (16) curved in an arc identical to the top blade and functions as a carrier to removably hold a commercially available eyelash curler insert (18). The insert (18) is composed of soft foam or rubber. The concave faces of the upper and lower jaws are shaped in an arc with an arc radius of approximately 4 mm.

Figure 2:
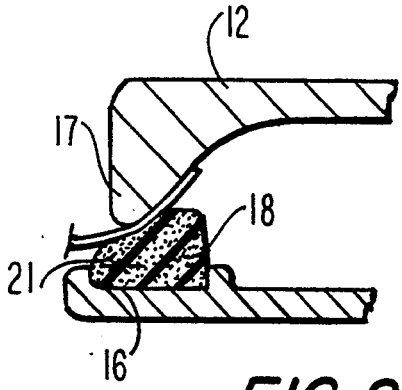
FIG. 2 is a detailed view of the jaws of the eyelash curler in a closed position.
Figure 3:
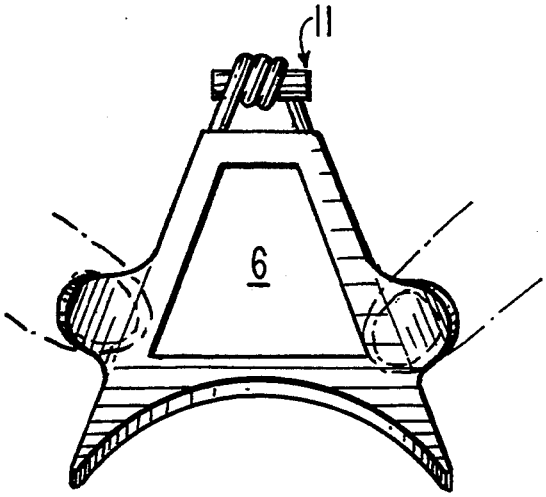
FIG. 3 is a$^t$ top view of the eyelash curler with the user's fingertips placed on the tabs.
Figure 4:
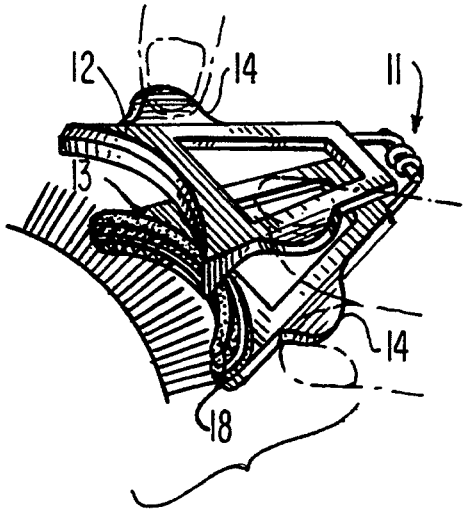
FIG. 4 is a perspective view of the eyelash curler.

The improved eyelash curler of the present invention gives a better curl than previous devices because of the viewing aperture (6) created by the jaws 12 and 13, the two-handed operation, and the location of the finger tabs close to the eyelash to be curled as shown in FIGS. 3 and 4. The finger tabs (14) and (15) project from the upper and lower jaws (12) and (13) to enable the user to securely grip each complementary pair of finger tabs preferably between the thumb and the forefinger of each hand. The jaws (12)and (13) are interconnected by the spring (11) at the distal end (20) of the curler (10) and engage one another upon compressing the tabs (14) and (15). The upper jaw (12) engages the lower jaw (13) at the leading edge (21) of the flexible curler insert (18), which, as is shown in FIG. 2, deforms slightly as it is compressed to curl the eyelash. In addition the shape of the edge of the upper jaw is improved with a rounded edge to create a better curl.

The viewing aperture enables the user to more accurately place, with regard to other direct force appliances, the device on the eyelash because it provides a direct view of the operation.

The two-handed operation of the eyelash curler produces several favorable results. It enables the user to apply more pressure to the lash, delivering a better curl. It also produces more control and, thus less intimidation to the user, e.g. a steadier application of pressure as unwanted side-to-side moves during curling are nearly cancelled by the opposing hand. A steadier application results in reduced eyelash loss. It has been found that by using the above 2-handed operation, pressure need only be applied for a period of between 5 to 20 seconds to produce the desired degree of curl.

The placement of the finger tabs 14, 15, 19 as well as a fourth tab not shown, near the lash to be curled also produces several favorable results. It enables the pressure to be applied to the lash more accurately than in previous devices because the pressure is direct rather than indirect. This placement also eliminates confusion on the part of the user of conventional indirect force appliances as to what angle to place the device in reference to the face. The user is less intimidated by having the controlling fingers closer to the eye and the grip is less awkward.

It is understood that the above-described embodiment is merely illustrative of the possible specific embodiments which may represent principles of the present invention. Other arrangements may readily be devised in accordance with these principles by those skilled in the art without departing from the scope of the invention.

What I claim is:

1. An eyelash curler comprising:

an upper jaw and a lower jaw, each of said jaws having a concave side in the form of an arc that is parallel to a curve of a front of an eye, said upper jaw having a rounded blade projecting from said concave side, said lower jaw having a member extending from the concave side for receiving a flexible insert with said member facing the projection extending from said upper jaw, said jaws having an open structure including an aperture large enough for the eye to view the placement of the eyelash curler on the eyelash to be curled, a pair of finger tabs for each jaw adjacent to each concave side and in a complementary relationship to one another for uniformly applying pressure to the eyelash using two hands while viewing the eyelash through said aperture and spring means for maintaining said upper and lower jaws joined at a distal end of the eyelash curler in a normally open position.

2. An eyelash curler as recited in claim 1 where the jaws are shaped approximately triangular.

3. An eyelash curler as recited in claim 1 where the jaws are shaped approximately quadrilateral.

4. An eyelash curler as recited in claim 1 where the angle between the upper and lower jaws is substantially 30 degrees.

5. An eyelash curler as recited in claim 2 where the angle between the upper and lower jaws is substantially 30 degrees.

6. An eyelash curler as recited in claim 3 where the angle between the upper and lower jaws is substantially 30 degrees.

7. An eyelash curler as recited in claim 1, wherein said eyelash is curled by applying pressure for a period of from five to twenty seconds.

8. An eyelash curler for curling eyelashes comprising:

an upper jaw end a lower jaw each of substantially triangular configuration, and each of said jaws having a concave side in an arc that is substantially parallel to a curve of a front of an eye, said concave side of the upper jaw holding a blade, said concave side of the lower jaw having a carrier with a foam cushion insert, the triangular configuration of each of said jaws forming an aperture large enough to view the eyelash to be curled and each of said jaws having two finger tabs projecting from said upper and lower jaws respectively and being located located near said concave side, to permit the eyelash to be curled using a two handed operation and spring means for maintaining said upper and lower jaws joined in a normally open position.

* * * * *